United States Patent [19]

Bock

[11] 4,261,289

[45] Apr. 14, 1981

[54] MAGNETIC BRUSH DEVICE FOR DEVELOPING ELECTROSTATIC CHARGE IMAGES

[75] Inventor: Hartmut Bock, Kelkheim, Fed. Rep. of Germany

[73] Assignee: Hoechst Aktiengesellschaft, Frankfurt am Main, Fed. Rep. of Germany

[21] Appl. No.: 61,250

[22] Filed: Jul. 27, 1979

[30] Foreign Application Priority Data

Aug. 4, 1978 [DE] Fed. Rep. of Germany ..... 2834264

[51] Int. Cl.[3] ..... G03G 15/09

[52] U.S. Cl. ..... 118/652; 118/658

[58] Field of Search ..... 118/656, 657, 658, 652, 118/204; 355/3 DD, 15; 430/122

[56] References Cited

U.S. PATENT DOCUMENTS

| | | | |
|---|---|---|---|
| 3,081,737 | 3/1963 | Frantz et al. | 118/657 X |
| 3,866,575 | 2/1975 | Kitajima et al. | 118/657 |
| 3,884,571 | 5/1975 | Lux | 355/3 |
| 3,918,808 | 11/1975 | Narita | 355/3 DD X |
| 3,982,498 | 9/1976 | Wilcox | 355/3 DD X |
| 3,999,514 | 12/1976 | Abbott et al. | 118/657 |
| 4,040,387 | 8/1977 | Washio et al. | 118/658 |
| 4,111,152 | 9/1978 | Sakamoto | 118/658 X |

*Primary Examiner*—John P. McIntosh

*Attorney, Agent, or Firm*—Schwartz, Jeffery, Schwaab, Mack, Blumenthal & Koch

[57] ABSTRACT

Disclosed is a magnetic brush device for use in a photocopy machine for applying a developer comprised of a toner and magnetic carrier particles to electrostatic charge images on a photoconductive recording medium on a rotating drum, comprising a magnetic brush roller rotatably mounted axially parallel and in spaced relationship to the drum; a doctor blade positioned adjacent the magnetic brush roller for metering the quantity of developer carried by the roller, this doctor blade converging to a point substantially adjacent the surface of the magnetic brush roller in the regions near both ends of the roller, to define a transition zone at each end thereof; and two elastic wiper members comprised of non-magnetic material mounted to bear against the drum, one in each of the transition zones, for wiping the magnetic carrier particles from the drum and for limiting the width of the developer applied by the magnetic brush roller to the drum.

7 Claims, 3 Drawing Figures

MAGNETIC BRUSH DEVICE FOR DEVELOPING ELECTROSTATIC CHARGE IMAGES

BACKGROUND OF THE INVENTION

The present invention relates to a magnetic brush device for developing electrostatic charge images on a photoconductive recording coating. In such a device, a developer consisting of a toner and of magnetic carrier particles is applied to the charge images, and the toner adheres to the charge images. The device has a doctor blade which bears against the magnetic brush roller, meters the quantity of carrier particles introduced by the magnetic brush roller for development and, at the ends of the roller, approaches the face of the roller.

A developing device of this general type is disclosed in German Offenlegungsschrift No. 2,436,890, wherein the carrier particles of the developer, after the end of the developing step, are removed from the photoconductive or dielectric recording coating by the action of magnetic forces. For this purpose, a magnet which, for example, is designed as a magnetic roller, is arranged at a small distance from the recording coating carrying the charge images. The distance between the magnet and the recording coating must, therefore, be such that the carrier particles cannot be jammed between the coating and the magnet.

German Offenlegungsschrift No. 2,162,842 describes a cascade developing device for an electrostatic copying apparatus which has a collecting device for removing the carrier particles adhering to the surface of the photoconductor drum. The collecting device consists of a sealing strip which does not touch the photoconductor drum and is formed from thin elastic material, for example, plastic, and which has a collecting edge. The collecting edge of the sealing strip is arranged at an adjustable distance from the carrier drum, which distance corresponds to about one tenth up to about half the diameter of the carrier particles. Neither wiping devices additional to the sealing strip nor a magnetic roller are provided.

U.S. Pat. No. 3,884,571 relates to a developing device having device for the developer extending in the shape of a trough in the axial direction along a drum immediately below the space between a developing station and the photoconductive recording surface of the drum. The base area of the trough comprises an upwardly-pointing, angled wiping lip which is located close to the surface of the drum and collects the developer which trickles down from the developing station. The developer collected in the trough is conveyed to an outlet opening with the aid of an endless revolving belt. Removal of the developer from the photoconductive recording coating by means of the magnetic roller is not envisaged.

In the case of developing devices which use a magnetic roller for applying the developer to the photoconductive recording coating and employ a doctor blade for wiping the developer from the surface of the magnetic roller, an increased discharge of carrier particles on the photoconductive recording coating is found in the region of the doctor transition, that is to say, the doctor zone close to the end faces of the magnetic roller, as compared with the center of the doctor blade. This makes it necessary to design the collectors so that they take up varying amounts of developer over the length of the doctor blade, as a result of which the manufacturing costs are increased.

SUMMARY OF THE INVENTION

It is, therefore, an object of the invention to provide an improved magnetic brush device for developing electrostatic charge images.

It is a further object of the invention to provide such a device which produces as uniform as possible a discharge of carrier particles over the length of the doctor blade and in the doctor transition zones close to the end faces of the magnetic brush roller, to achieve a discharge value which corresponds to the value in the center of the doctor blade.

Another object of the invention resides in the provision of an improved photocopy apparatus embodying the improved magnetic brush device according to the invention.

In accomplishing the foregoing objects, there has been provided, in accordance with the present invention, a magnetic brush device for use in a photocopy machine for applying a developer comprised of a toner and magnetic carrier particles to electrostatic charge images on a photoconductive recording medium on a rotating drum. The device comprises a magnetic brush roller rotatably mounted axially parallel and in spaced relationship to the drum; a doctor blade positioned adjacent the magnetic brush roller for metering the quantity of developer carried by said roller, the doctor blade converging to a point substantially adjacent the surface of the magnetic brush roller in the regions near both ends of the roller, to define a transition zone at each end of the roller; two elastic wiper members comprised of non-magnetic material mounted to bear against the drum, one in each of the transition zones, for wiping the magnetic carrier particles from the drum and for limiting the width of the developer applied by the magnetic brush roller to the drum. Preferably, each wiper member extends both outwardly and inwardly of its respective transition zone of the doctor blade, with the inward coverage in the direction of the center of the doctor blade being at least about 4 mm.

In another aspect of the present invention, there has been provided a photocopy apparatus including a rotating drum having a surface layer of a photoconductive recording medium and a magnetic brush device for applying a developer comprised of a toner and magnetic carrier particles to electrostatic charge images on the drum, wherein the improvement comprises utilizing, as the magnetic brush device, the above-defined device according to the present invention.

Other objects, features and advantages of the present invention will become apparent from the following Detailed Description of Preferred Embodiments, when considered together with the attached figures of drawing.

DETAILED DESCRIPTION OF PREFERRED EMBODIMENTS

According to the invention, two elastic wipers are provided next to the doctor blade which consist of a non-magnetic material and bear against the photoconductive recording coating and wipe the carrier particles from the latter. One wiper limiting the developing width of the magnetic brush roller is arranged in both the region of the lefthand transition zone and in the region of the right-hand transition zone of the doctor blade, as viewed from above in the direction of the doctor blade.

The two wipers are located downstream of the developing station in the direction of motion of the photoconductive recording coating.

The invention results in the advantage that, in the region of the transition zones of the doctor blade, a substantially smaller proportion of carrier particles is discharged, as compared with known developing devices, so that the downstream magnetic wiper of an inexpensive static design collects the small discharge in the center of the developing zone over long periods, without having to be emptied because of over-filling. Also faults in other sub-assemblies of the copying apparatus, caused by carrier particles which adhere to the photoconductive recording coating, are largely avoided. As is known, if the carrier particles are not removed from the recording carrier after the developing station, they cause local transfer faults, abrade the fixing rollers of the copying apparatus and can penetrate into bearings which can thus "seize".

The invention prevents difficulties of this kind so that the operation reliability of the copying apparatus is increased.

Figure 1:
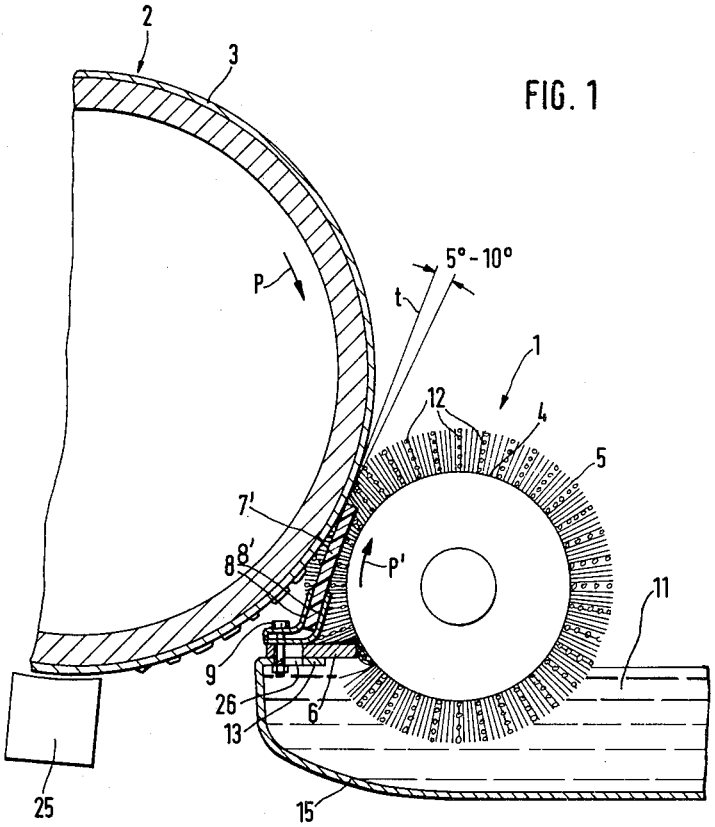
FIG. 1 is a side view of a section of a developing device according to the invention having a magnetic brush roller and wipers.

In the following text, the invention is explained in more detail with reference to the drawings. A magnetic brush developing device 1, shown in FIG. 1, for an electrostatic copying apparatus adjoins a drum 2, the surface of which is provided with a photoconductive recording coating 3 and which revolves in the direction of the arrow P. The electrostatic charge image or images which are to be developed are present on the recording coating 3. As is known, the developer consists of toner and of carrier particles which in general are magnetic. The electrostatic charge images attract the toner which adheres thereto and develops the charge images to give powder images. The carrier particles are removed from the developing zone by the photoconductive recording coating 3 and are stripped from the photoconductive recording coating 3 by a magnetic wiper 25 located downstream of the developing device 1. The magnetic brush roller 4 rotates in the direction of the arrow P',in the same direction of rotation as the drum 2, and carries on its surface a pile-like skin 5 of developer, which is wiped off by a doctor blade 6 which, in FIG. 1, is shown extending horizontally but which can also be inclined to the surface of the magnetic brush roller 4 in any other desired direction. As can be seen from FIG. 2, two elastic wipers 7', 7'', which can be for example of polyurethane, bearing against the photoconductive recording coating 3 to wipe the carrier particles 12 from the latter are located next to the doctor blade 6. The two wipers 7', 7'' are made of a non-magnetic elastic material which bears against the photoconductive recording coating 3 in such a way that its surface encloses an angle of between 5° and 10° with the tanget t to the recording coating 3 at the point of contact with the wipers. The wipers 7', 7'' enclose an angle of between 45° and 80° with the doctor blade 6.

The supply vessel 15 for the developer stock 11 has a bent-over edge 13 on which the doctor blade 6 and the wipers 7', 7'' are fastened by means of a screw 9. For this purpose, each wiper 7', 7'' is surrounded by two angled metal sheets, 8, 8', of which the lower metal sheet rests on the doctor blade 6. In the edge 13, there is a slot 26 so that it is possible to displace the screw 9 in the slot and hence to vary the distance of the doctor blade 6 from the surface of the magnetic brush roller 4.

Figure 2:
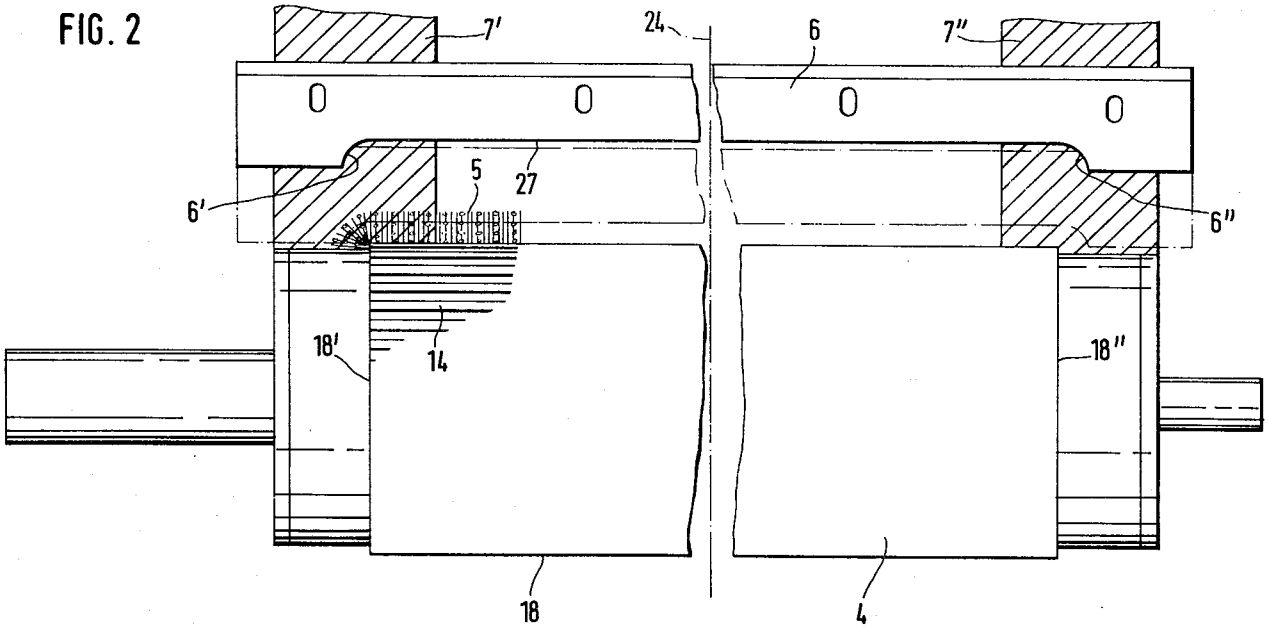
FIG. 2 is a diagrammatic view of the magnetic brush roller, of a doctor blade and of the wipers according to FIG. 1.

As can be seen from FIG. 2, the surface of the cylinder shell 18 of the magnetic brush roller 4 is provided with striations 14 which promote the formation of the skin 5 of developer. The doctor blade 6 has a left-hand transition zone 6' and a right-hand transition zone 6'', that is to say, these are in each case the regions close to the end faces 18', 18'' of the cylinder shell 18. In the transition zones 6', 6'', the wiping edge 27 of the doctor blade 6 extends with a downward curvature. In FIG. 2, the wipers 7', 7'' are hatched in order to indicate that they are not in the same plane as the doctor blade 6 but are located behind the latter. Viewed from above in the direction from the wipers 7', 7'' to the doctor 6, each wiper 7', 7'' covers the transition zone 6' or 6'' respectively of the doctor blade 6 outwardly and inwardly, the inward coverage in the direction of the center line 24 of the doctor blade being at least 4 mm, while the outward coverage is in general 10 mm and greater. In an exemplary embodiment, the wiper has, for example, dimensions of 18 mm ×2 mm and is 30 mm wide. The elastic wipers 7', 7'' prevent the discharge of carrier particles 12 from the photoconductive recording coating 3 in the region of the transition zones 6', 6'' of the doctor blade so that the carrier particles which have been wiped off can be attracted with ease by the magnetic field of the magnetic brush roller 4. As a result, no carrier particles remain underneath the wipers 7', 7''; rather, the particles are completely returned again into the developer circulation. Therefore, the elastic wipers 7'7'' do not necessitate a rotary wiper, as is sometimes used in known devices. Since the amount of developer discharged from the developing station is greatly reduced by the wipers, the magnetic wiper 25 for the toner particles, downstream of the developing station, need be emptied only very infrequently.

Figure 3:
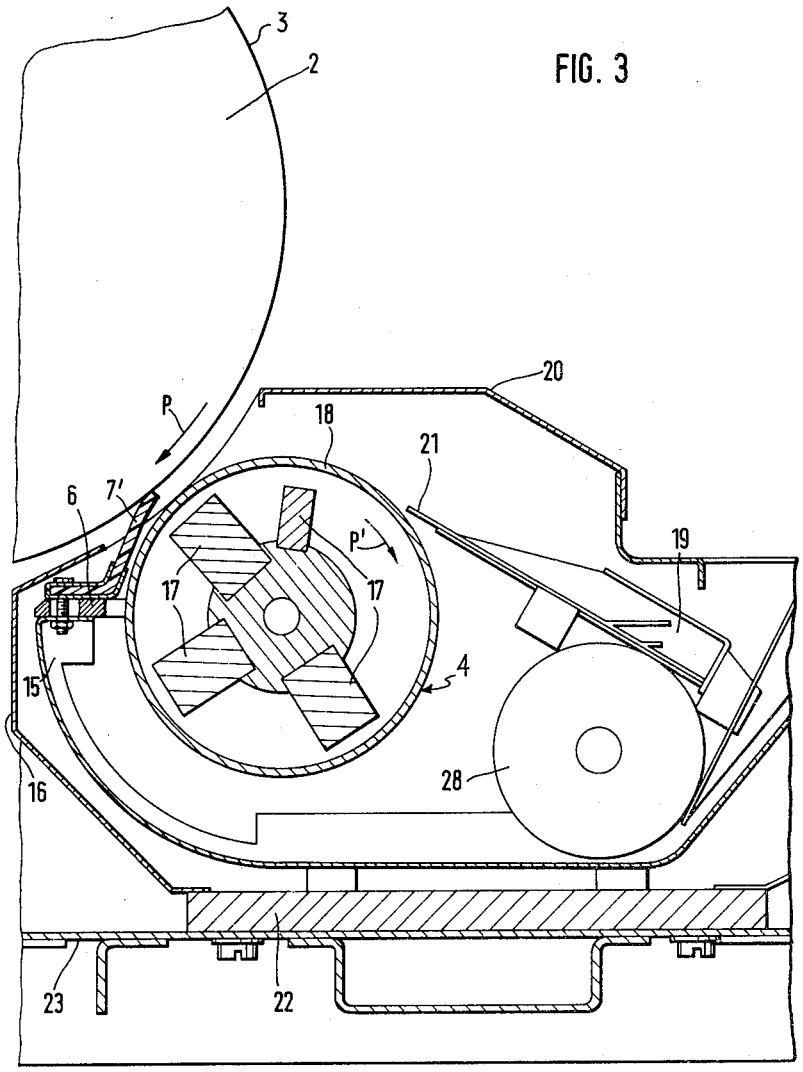
FIG. 3 is a side view of a section of a developing device similar to that according to FIG. 1.

FIG. 3 shows the construction of the magnetic brush roller 4 which has magnets 17 within the cylinder shell 18 for generating the magnetic field required for the skin of developer.

A cover 20 closes the top of the developing device, and a side part 16 surrounds the supply vessel 15. Between the side part 16 and the cover 20, an opening is provided, and in this region the magnetic brush roller 4 is located close to the photoconductive recording coating 3. The side part 16 is joined to a base plate 22, which is fixed to a frame 23 by means of screws. Behind the magnetic brush roller 4 there is a collector 19 having a wiper sheet 21 which extends tangentially to the surface of the cylinder shell 18 of the magnetic brush roller 4 in order to wipe the skin of developer, which is not shown, from the surface thereof. From the collector 19, the developer which has been wiped off passes into a circulating device 28, for example, a conveyor screw which circulates the developer. The arrangement of the doctor blade 6 and of the wipers 7', 7'' is similar to that in FIG. 1 and is thus not described again.

What is claimed is:

1. A magnetic brush device for use in a photocopy machine for applying a developer comprised of a toner and magnetic carrier particles to electrostatic charge images on a photoconductive recording medium on a rotating drum, comprising:

a magnetic brush roller rotatably mounted axially parallel and in spaced relationship to the drum;

a doctor blade means positioned adjacent said magnetic brush roller for metering the quantity of developer carried by said roller, said doctor blade means converging to a point substantially adjacent the surface of said magnetic brush roller in the regions near both ends of said roller, to define a transition zone at each of said roller; and two elastic wiper members comprised of non-magnetic material mounted to bear against the drum, one in each of said transition zones, for wiping the magnetic carrier particles from the drum and for limiting the width of the developer applied by the magnetic brush roller to the drum; and wherein each wiper member extends both outwardly and inwardly of its respective transition zone of the doctor blade means, the inward coverage in the direction of the center of the doctor blade means being at least about 4 mm.

2. A magnetic brush developing device as claimed in claim 1, wherein the doctor blade means bears horizontally against the magnetic brush roller and the surfaces of the two wiper members bear in elastic contact with the photoconductive recording medium on the drum and enclose an angle of from about 5° to 10° with a tangent (t) to the drum at the point of contact.

3. A magnetic brush developing device as claimed in claim 2, wherein said wiper members and the doctor blade means are mounted with an incline with respect to each other.

4. A magnetic brush developing device as claimed in claim 3, wherein the angle between the wiper members and the doctor blade means is between about 45° and 80°.

5. A magnetic brush developing device as claimed in claim 1, further comprising a supply vessel for developer positioned below said magnetic brush roller, two angled members for holding each of said wiper members, wherein the lower angled member for each wiper rests on the doctor means, and wherein the two angled members for each wiper and the doctor blade means are adjustably joined by a fixing element to one edge of said supply vessel.

6. In a photocopy apparatus including a rotating drum having a surface layer of a photoconductive recording medium and a magnetic brush device for applying a developer comprised of a toner and magnetic carrier particles to electrostatic charge images on the drum, the improvement comprising said magnetic brush device comprising the device as defined by claim 1.

7. A magnetic brush developing device as claimed in claim 1, wherein said two elastic wiper members are spaced apart from each other by a distance which corresponds to a substantial part of the axial width of the magnetic brush roller.

* * * * *